US011180927B2

(12) United States Patent
Newcomb

(10) Patent No.: US 11,180,927 B2
(45) Date of Patent: Nov. 23, 2021

(54) PORTABLE AND COLLAPSIBLE GROUND BLIND AND METHOD OF USING SAME

(71) Applicant: Nukem, LLC, Swannanoa, NC (US)

(72) Inventor: Patrick D. Newcomb, Asheville, NC (US)

(73) Assignee: Nukem, LLC, Swannanoa, NC (US)

( * ) Notice: Subject to any disclaimer, the term of this patent is extended or adjusted under 35 U.S.C. 154(b) by 0 days.

(21) Appl. No.: 17/037,890

(22) Filed: Sep. 30, 2020

(65) Prior Publication Data

US 2021/0108438 A1 Apr. 15, 2021

Related U.S. Application Data

(60) Provisional application No. 62/913,491, filed on Oct. 10, 2019.

(51) Int. Cl.
*E04H 15/00* (2006.01)
*E04H 15/26* (2006.01)

(52) U.S. Cl.
CPC ..... *E04H 15/001* (2013.01); *E04H 15/26* (2013.01)

(58) Field of Classification Search
CPC ..... E04H 15/001; E04H 15/26; E04H 15/58
USPC ..... 160/372, 377
See application file for complete search history.

(56) References Cited

U.S. PATENT DOCUMENTS 820,769 A * 5/1906 DeJonge, Jr. ..... A47G 23/03 160/230
1,415,482 A * 5/1922 Reed ..... E04H 15/24 135/100
2,934,076 A * 4/1960 Fulke ..... E04H 15/003 135/147
3,174,493 A * 3/1965 Gruenberg ..... E04H 15/003 135/143
4,777,755 A * 10/1988 Colburn ..... A01M 31/025 43/1
5,655,558 A * 8/1997 Child ..... E04H 15/003 135/100
6,138,700 A * 10/2000 Stoddart ..... E04H 15/003 135/116
6,145,528 A * 11/2000 Egnew ..... E04H 12/2215 135/114
6,857,460 B1 * 2/2005 Mowry ..... F41H 5/06 160/351
10,865,584 B1 * 12/2020 Hulsey ..... E04H 15/02
2018/0066446 A1 * 3/2018 Nolz ..... E04H 15/48
2020/0370326 A1 * 11/2020 Bird ..... E04H 15/001

* cited by examiner

*Primary Examiner* — Noah Chandler Hawk
(74) *Attorney, Agent, or Firm* — Ward and Smith, P.A.; Ryan K. Simmons

(57) ABSTRACT

A ground blind system is provided. The ground blind system may include a fabric panel; and a plurality of poles, wherein the plurality of poles may include a center support pole, wherein when installed the center support pole divides the fabric panel longitudinally into two smaller generally triangular shape portions of substantially the same size; and wherein in an assembled state the assembled structure of the fabric panel and plurality of poles may be configured such that the structure is self-supporting. A method of using the ground blind system may include, providing the ground blind system; installing the plurality of poles within the fabric panels to form the assembled structure; and adjusting the two smaller generally triangular shape portions to a desired angle therebetween.

20 Claims, 18 Drawing Sheets

SECTION C-C

PORTABLE AND COLLAPSIBLE GROUND BLIND AND METHOD OF USING SAME

RELATED APPLICATIONS

This application is related and claims priority to U.S. Patent Application No. 62/913,491, filed Oct. 10, 2019, entitled "Portable and Collapsible Ground Blind and Method of Using Same", the entire disclosure of which is incorporated herein by reference.

TECHNICAL FIELD

The subject matter of the present invention relates generally to devices used to camouflage or hide oneself, and more particularly to portable and collapsible ground blinds and methods of using same.

BACKGROUND

Ground blind systems exist today, such as pop-up blinds and throwdown blinds, e.g., hunting blinds. Generally, a pop-up blind is a four-sided structure with a roof that is supported with various rods, stakes, and ropes, much like a pop-up tent. Accordingly, a pop-up blind can be large, bulky to carry, and difficult to set up. Throwdown blinds, while less bulky than a pop-up blind, is typically required to be staked down or weighted down. Both pop-up blinds and throwdown blinds are designed to be setup and then not moved. However, due to changing conditions with animals there may be circumstances in which the user, e.g., a hunter, may wish to adjust the position of the blind on a moment's notice. Accordingly, pop-up blinds and throwdown blinds may have limitations because they cannot be easily and/or quickly moved.

SUMMARY

In one embodiment, a ground blind system is provided. The ground blind system may include a fabric panel; and a plurality of poles, wherein the plurality of poles may include a center support pole, wherein when installed the center support pole divides the fabric panel longitudinally into two smaller generally triangular shape portions of substantially the same size; and wherein in an assembled state the assembled structure of the fabric panel and plurality of poles may be configured such that the structure is self-supporting. The fabric panel may be one of a generally triangular or rhombus shape. The plurality of poles may include collapsible poles. The plurality of poles may further include a first side support pole and a second side support pole, wherein in the assembled state the first side support pole may be disposed along a first side edge of the fabric panel and the second side support pole may be disposed along a second side edge of the fabric panel. In the assembled state a first end of each of the center, first side, and second side support poles convene at a peak of the assembled structure, and wherein the first side support pole diverges along it length at a first angle away from the center support pole, and the second side support pole diverges along it length at a second angle away from the center support pole. The first end of each of the center, first side, and second side support poles may be engageable with one another via a first connector. The first angle and the second angle may be substantially equal. The plurality of poles may further include a first bottom support pole and a second bottom support pole, wherein in the assembled state the first bottom support pole may be disposed along a lower edge portion of a first one of the two smaller generally triangular shape portions and the second bottom support pole may be disposed along a lower edge portion of a second one of the two smaller generally triangular shape portions, and wherein a second end of the first bottom support pole may be engageable with a first end of the second bottom support pole. In the assembled state a second end of the center pole may be engageable with the second end of the first bottom support pole and the first end of the second bottom support pole. The second end of the center pole, second end of the first bottom support pole, and first end of the second bottom support pole may be engageable with one another via a second connector, and wherein the first bottom support pole and the second bottom support pole may be generally perpendicular relative to the center support pole. In the assembled state a second end of the first side support pole may be engageable with a first end of the first bottom support pole and a second end of the second side support pole may be engageable with a second end of the second bottom support pole. The second end of the first side support pole and the first end of the first bottom support pole may be engageable via a third connector and the second end of the second side support pole and the second end of the second bottom support pole may be engageable via a fourth connector. In the assembled state the two smaller generally triangular shape portions may be pivotable relative to one another. The ground blind system may further include a reinforced pocket at one or more corners of the fabric panel, wherein the reinforced pocket may be configured to receive an end of one or more of the plurality of poles engaged with an end of another one or more of the plurality of poles. The ground blind system may further include one or more openings in one or both of the two smaller generally triangular shape portions. The one or more openings may include a closeable window. The ground blind system may further include one or more strap loops disposed at one or more lower corners of the fabric panel.

In another embodiment, a method of using a ground blind system is provided. The method of using the ground blind system may include, providing a ground blind system, and the ground blind system may include a fabric panel; and a plurality of poles, including at least a center support pole, a first side support pole, and a second side support pole. The method may further include installing the plurality of poles within the fabric panels to form an assembled structure, wherein the first side support pole may be disposed along a first side edge of the fabric panel, the second side support pole may be disposed along a second side edge of the fabric panel, and the center support pole may be disposed such that it divides the fabric panel longitudinally into two smaller generally triangular shape portions of substantially the same size, wherein the assembled structure is self-supporting; and adjusting the two smaller generally triangular shape portions to a desired angle therebetween.

BRIEF DESCRIPTION OF THE DRAWINGS

Figure 1:
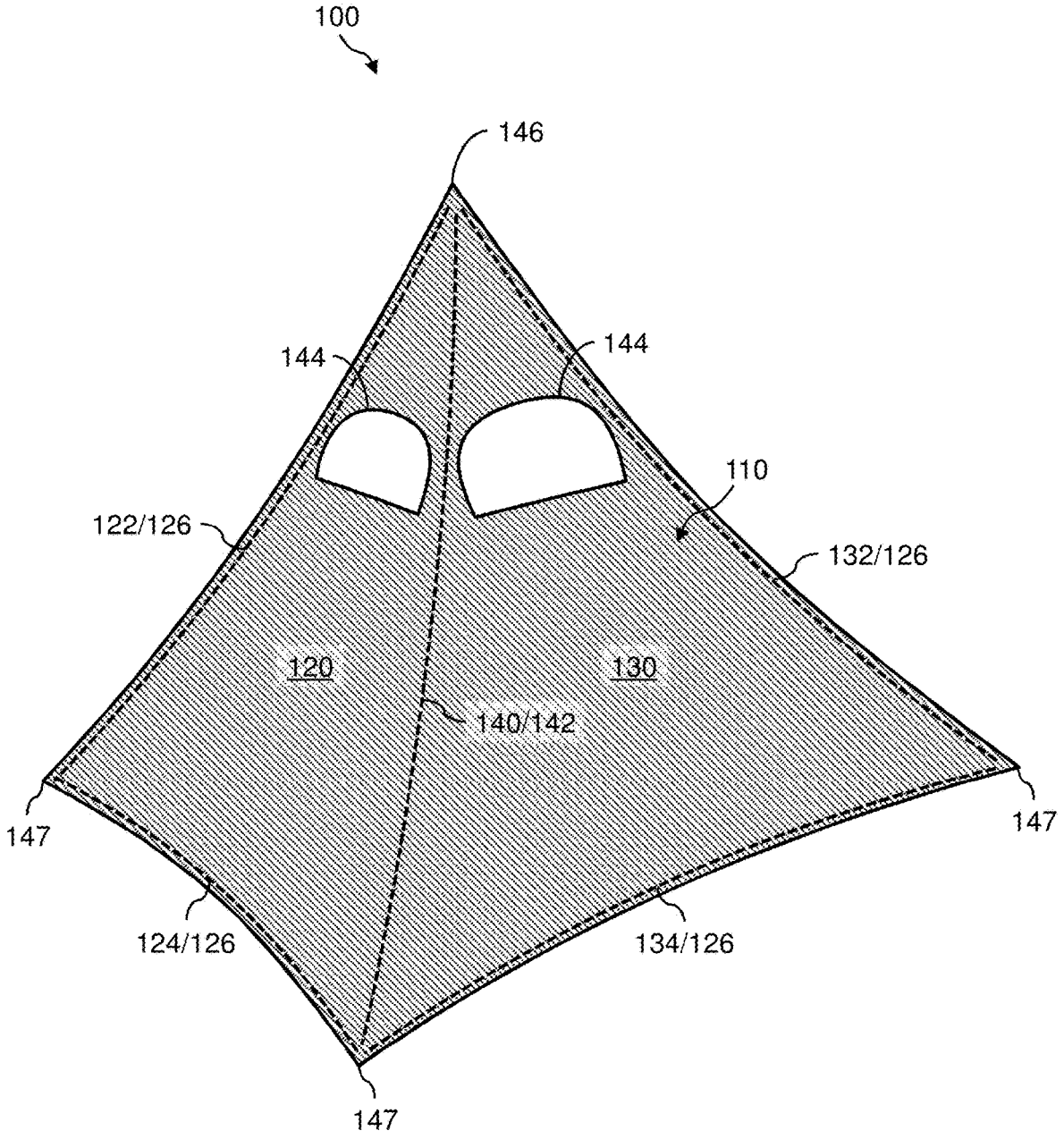
Figure 2:
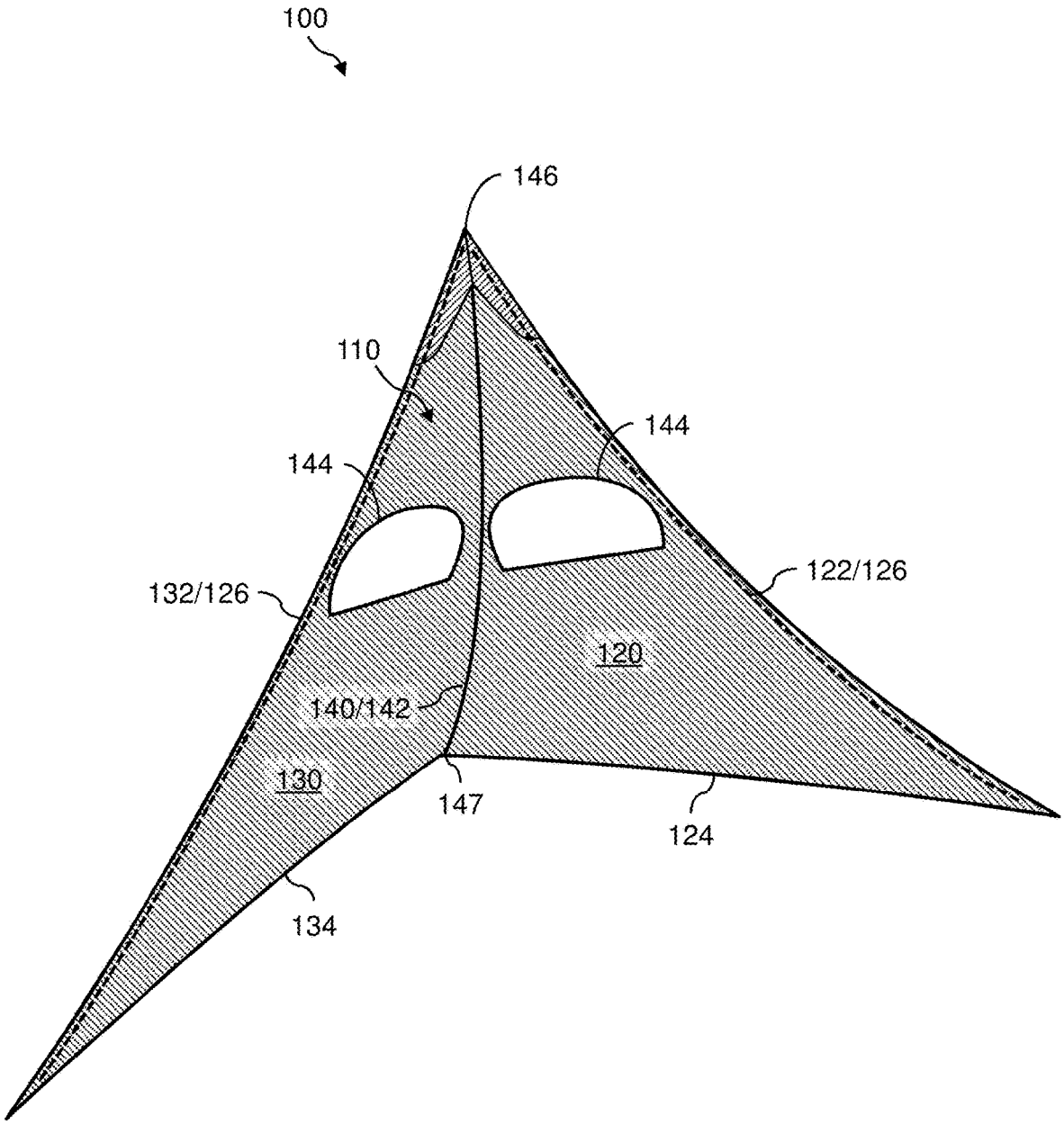
Figure 3:
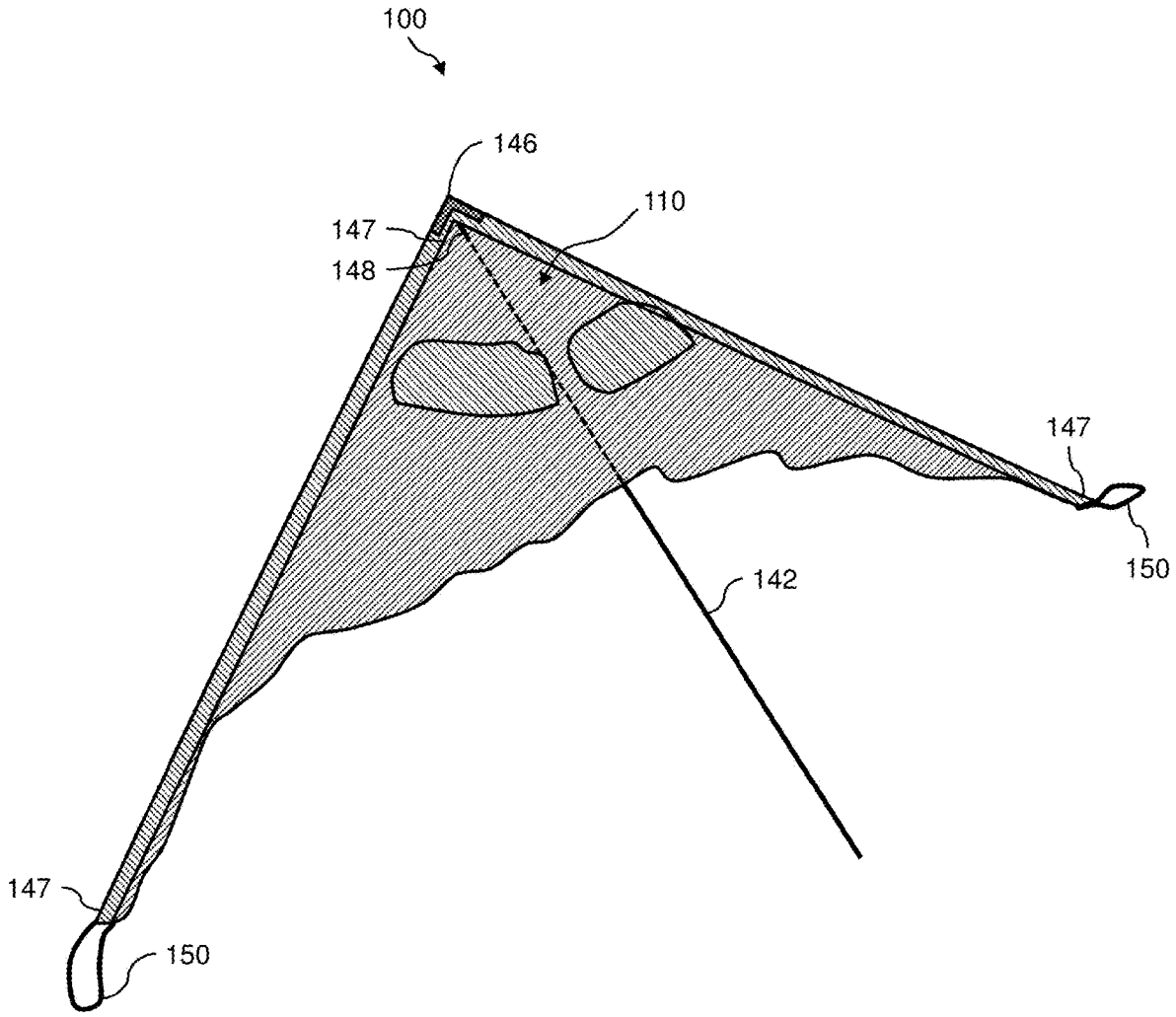
Figure 4:
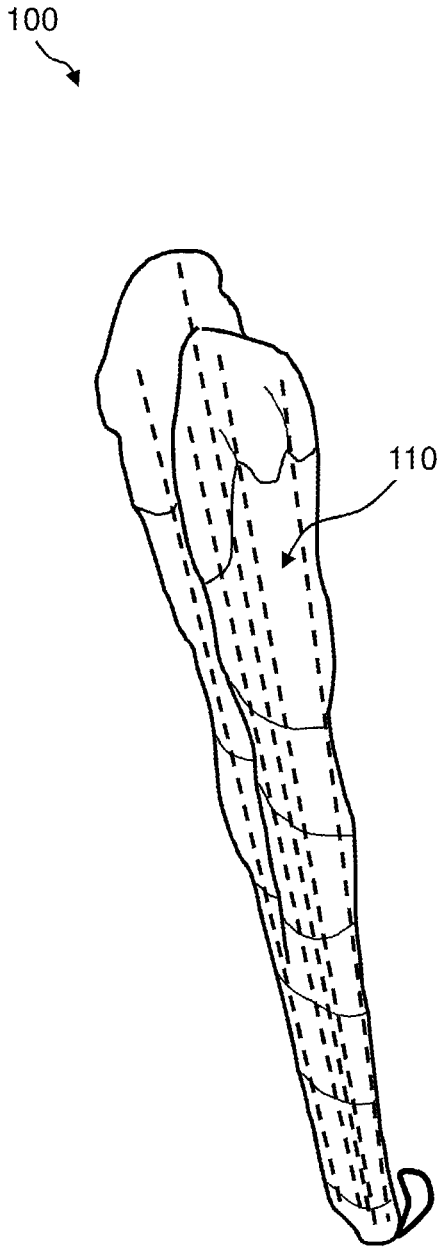
Figure 5A:
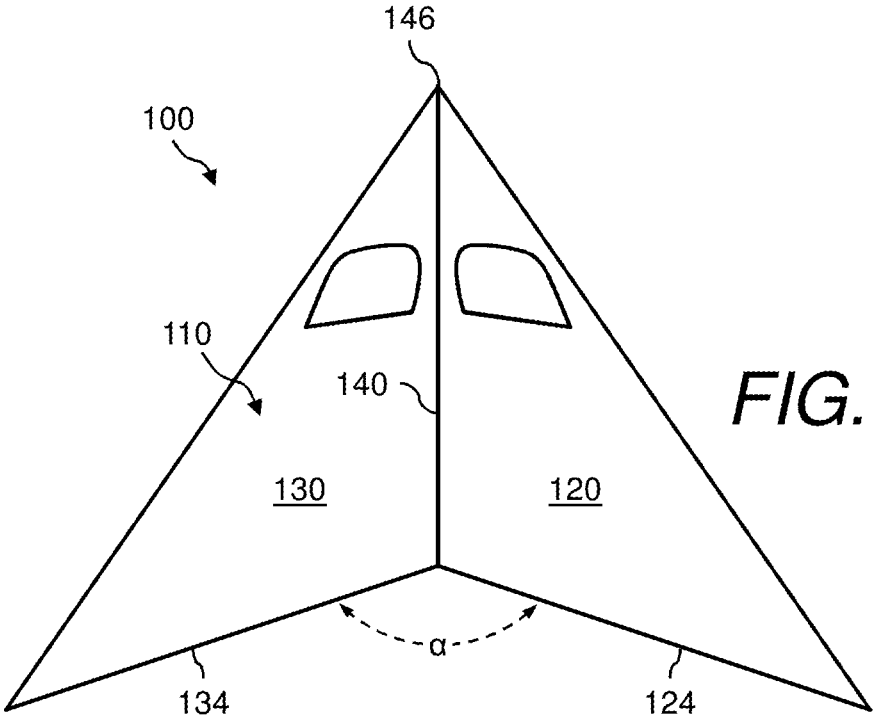
Figure 5B:
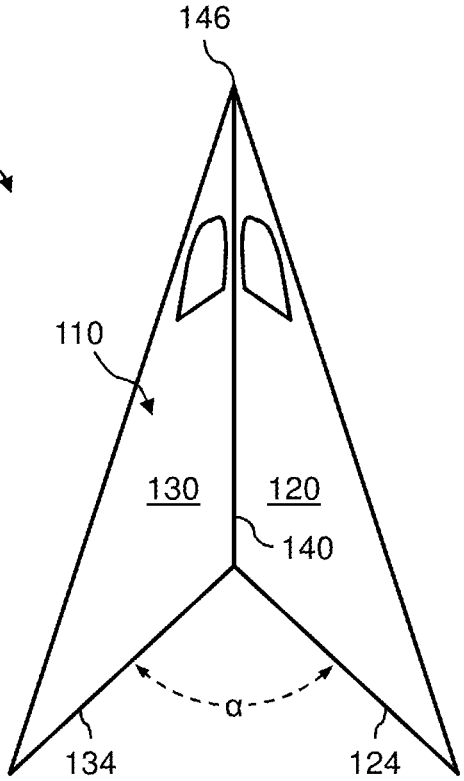
Figure 6:
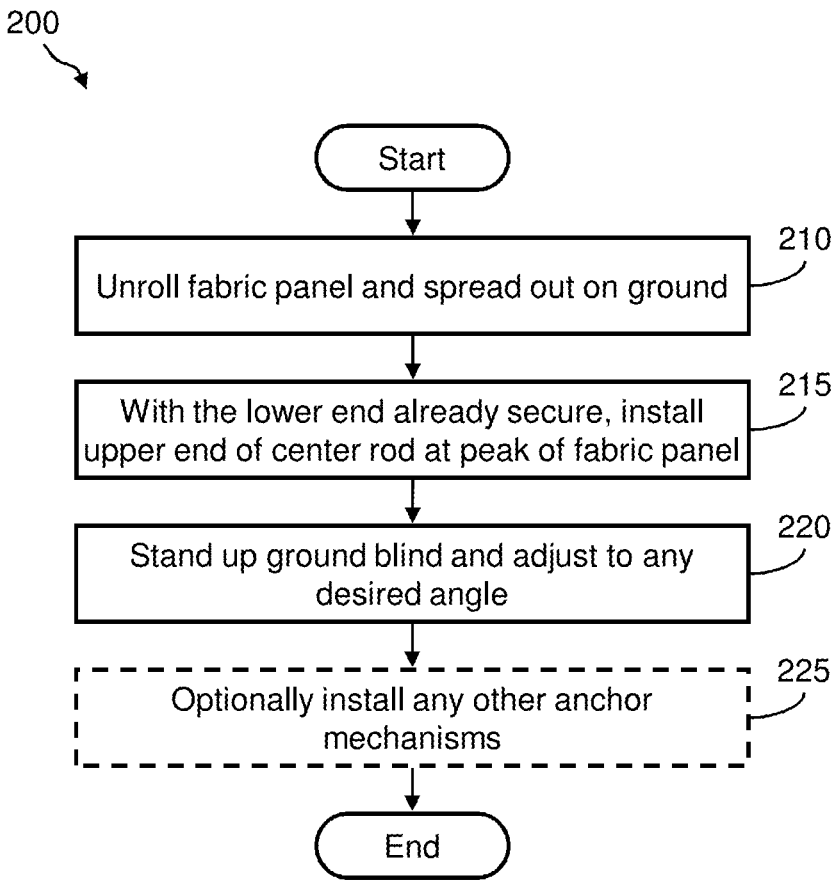
Figure 7:
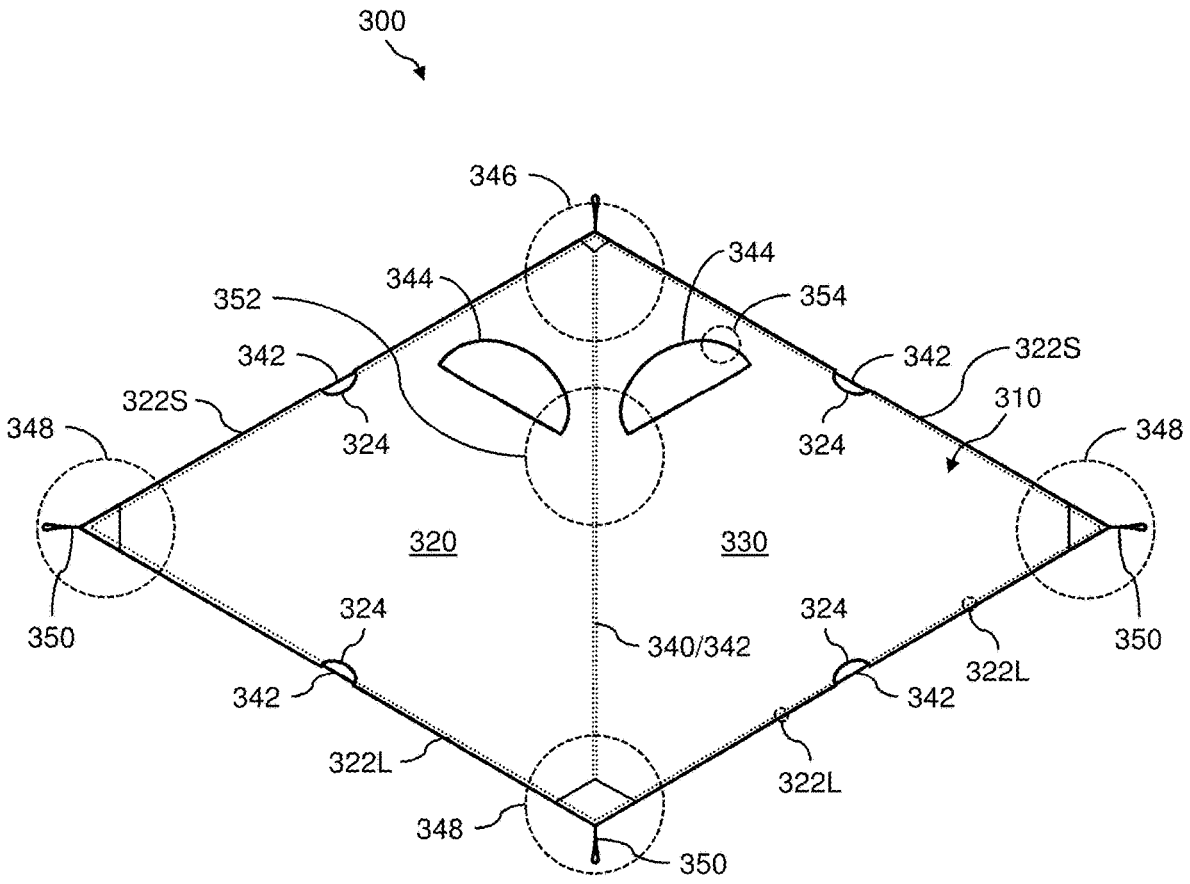
Figure 12:
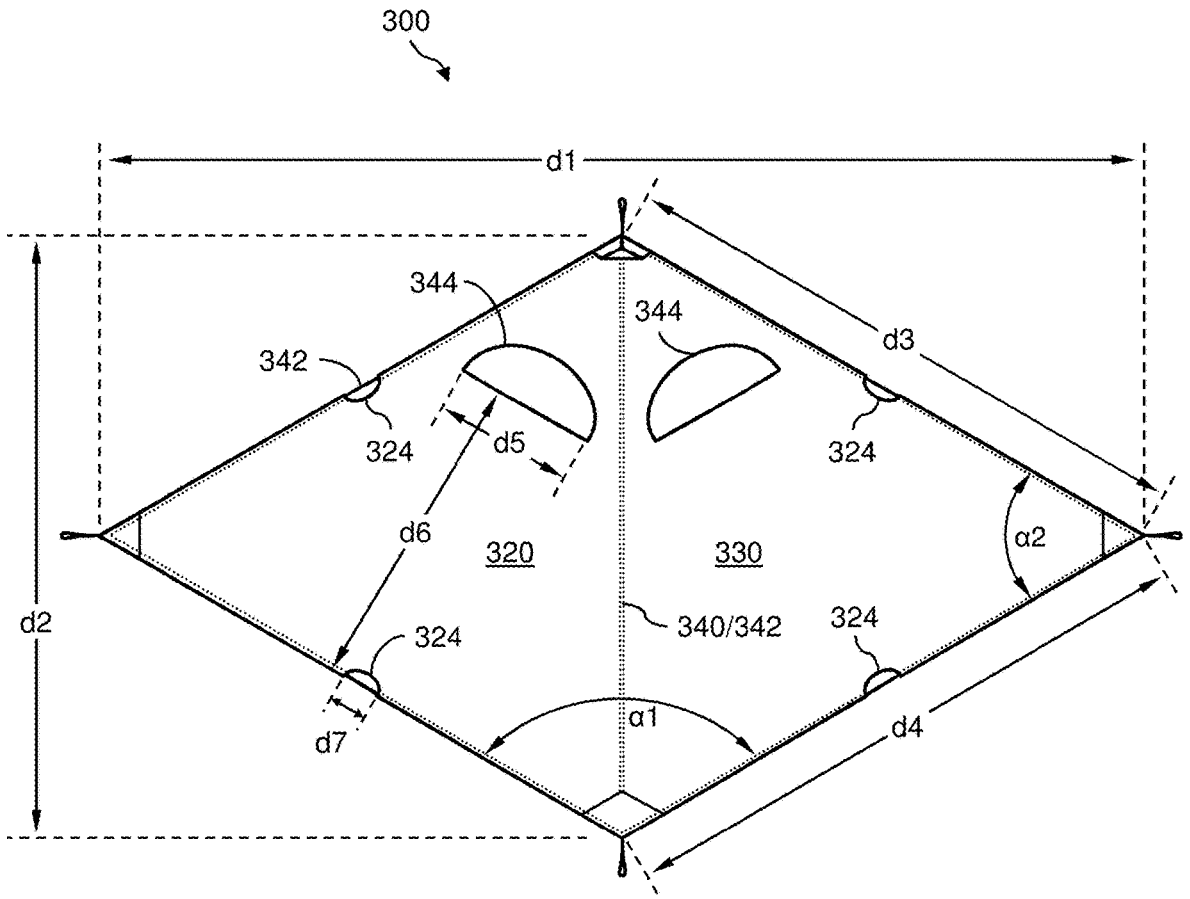
Figure 13:
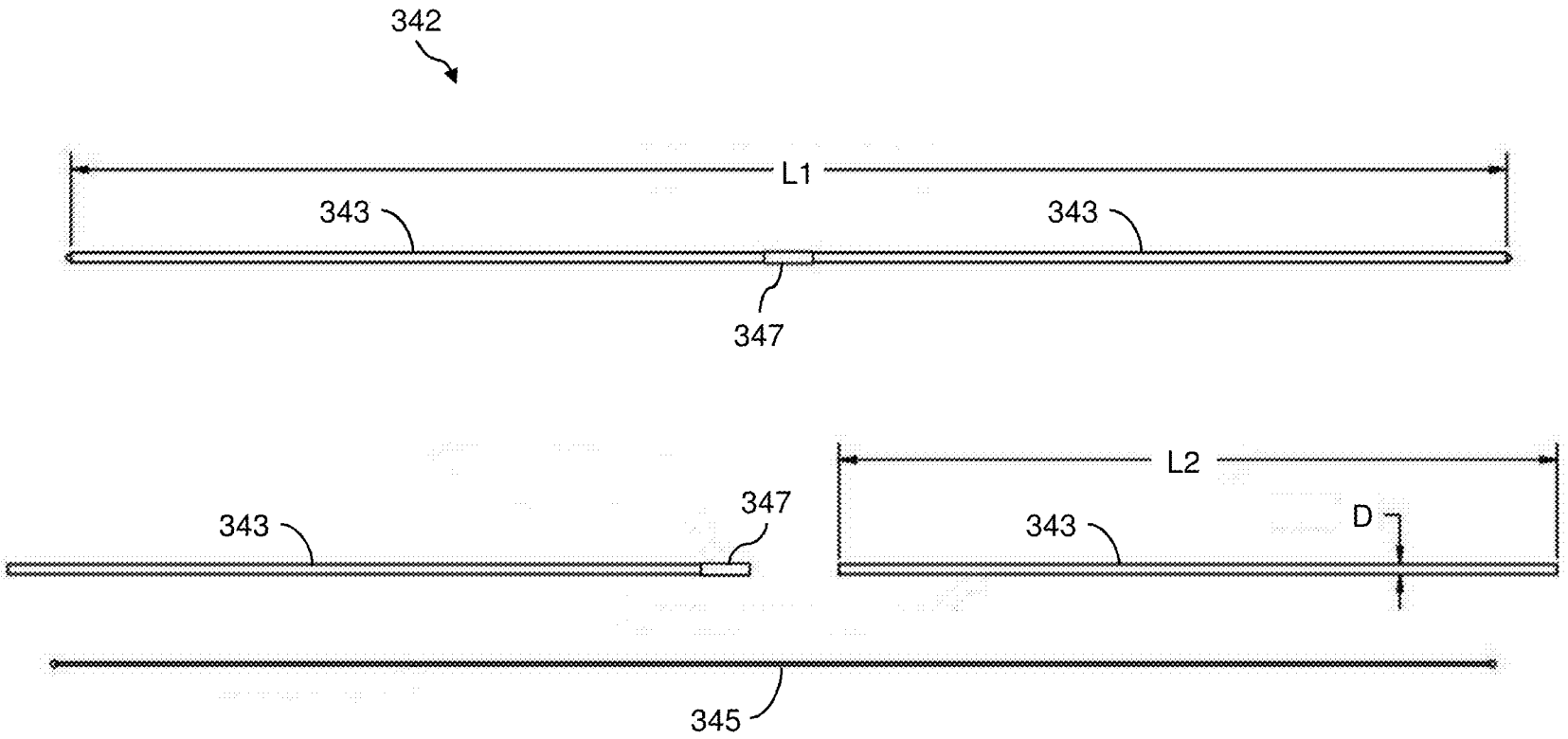
Figure 16:
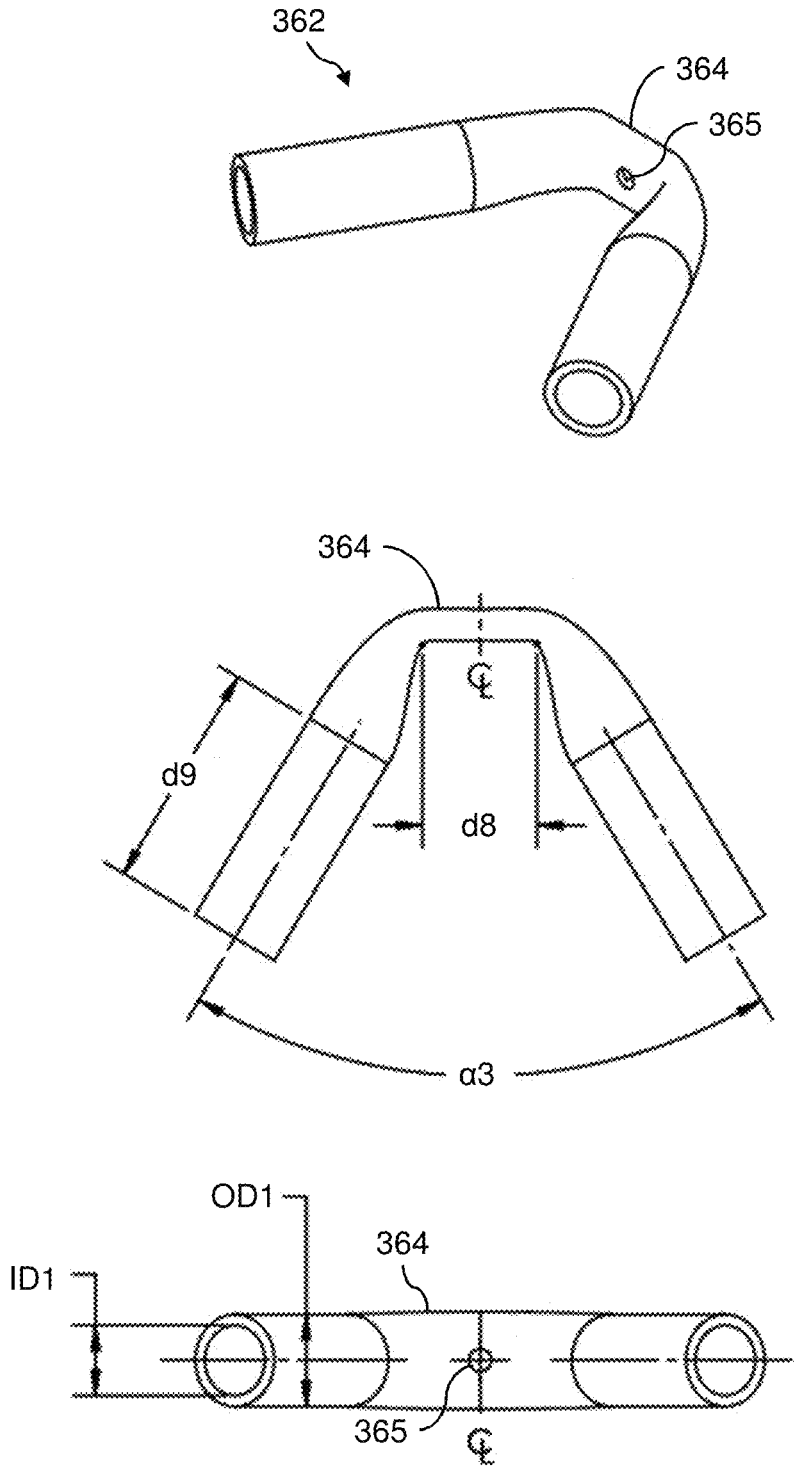
Figure 17:
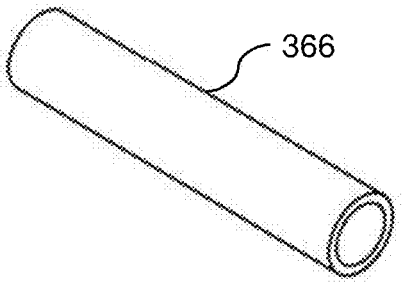
Figure 17:
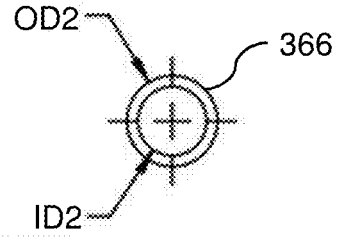
Figure 17:
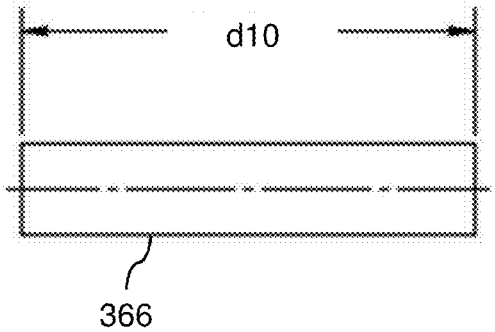
Figure 18:
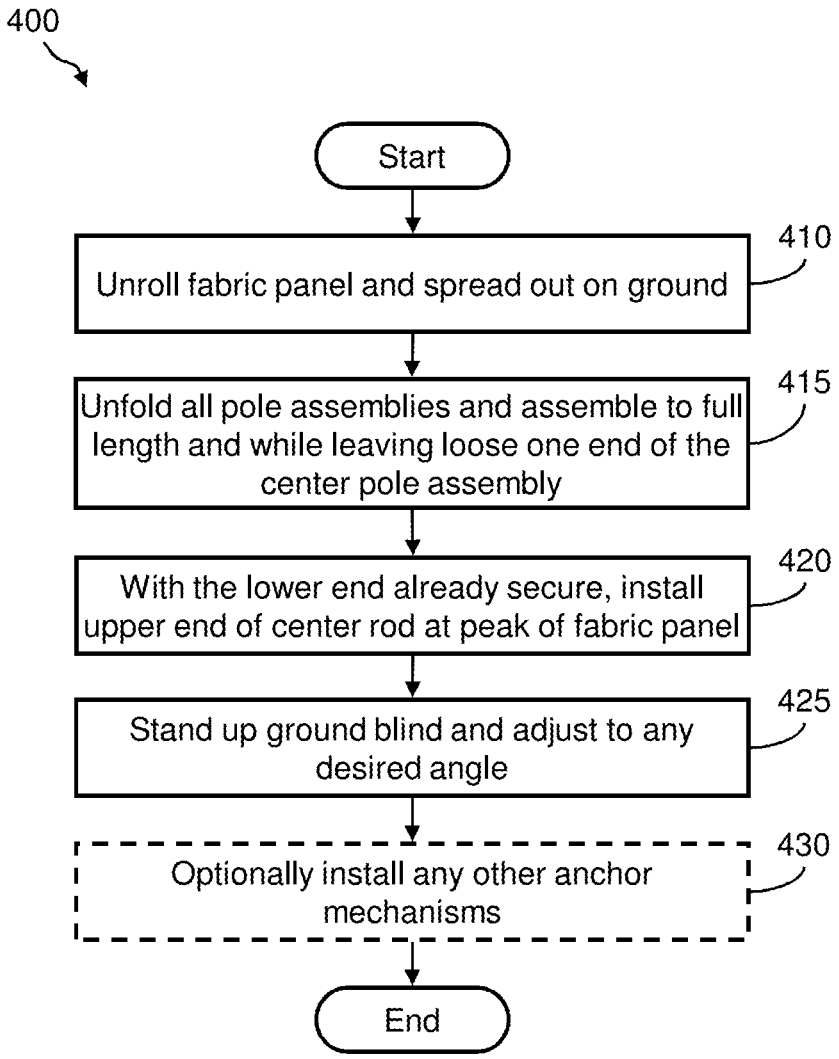

Having thus described the subject matter of the invention in general terms, reference will now be made to the accompanying drawings, which are not necessarily drawn to scale, and wherein:

FIG. 1 and FIG. 2 illustrate a front perspective view and a rear perspective view, respectively, of an example of a blind in accordance with an embodiment of the invention;

FIG. 3 illustrates an example of the blind shown in FIG. 1 and FIG. 2 spread out on the ground during setup;

FIG. 4 illustrates an example of the blind shown in FIG. 1 and FIG. 2 rolled up for carrying;

FIG. 5A and FIG. 5B illustrate schematic diagrams of an example of the blind shown in FIG. 1 and FIG. 2 set at different angles;

FIG. 6 illustrates a flow diagram of an example of a method of using the blind shown in FIG. 1 through FIG. 5B, which is one example of the blinds and methods in accordance with an embodiment of the invention;

FIG. 7 illustrates a plan view of another example of the blinds in accordance with an embodiment of the invention;

FIG. 8 through FIG. 11 illustrate plan views of various features of the blind shown in FIG. 7;

FIG. 12 illustrates a detailed drawing of an example of the blind shown in FIG. 7;

FIG. 13 illustrates a detailed drawing of an example of a pole assembly that may be used with the blind shown in FIG. 7;

FIG. 14 through FIG. 17 are various views showing details of an example of a pole connector assembly that may be used with the blind shown in FIG. 7; and FIG. 18 illustrates a flow diagram of an example of a method of using the blind shown in FIG. 7 through FIG. 17, which is another example of the blinds and methods in accordance with an embodiment of the invention.

DETAILED DESCRIPTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. Therefore, it is to be understood that the subject matter of the present invention is not to be limited to the specific embodiments disclosed and that modifications and other embodiments are intended to be included within the scope of the appended claims.

In some embodiments, the subject matter of the present invention provides a portable and collapsible ground blinds and methods of using same. In some embodiments, the presently disclosed blind includes a triangular-shaped fabric panel (e.g., camouflage fabric). Then, by installing a center pole or rod, the triangular-shaped fabric panel is divided or partitioned into two smaller triangular-shaped side panels. The angle between the two smaller triangular-shaped side panels can be rapidly adjusted for standing up and leveling the blind. Further, each of the two smaller triangular-shaped side panels may include a window or opening that a user can look through.

Further, a method of using the portable and collapsible ground blind is provided.

While the subject matter of the present invention is generally described herein below as a portable and collapsible hunting ground blinds and methods, this is exemplary only. The inventive blind may be used for any purpose, such as, but not limited to, a blind for observation, photography, and the like. Additionally, the inventive blind may be used as a sun shade or sun screen device.

Referring now to FIG. 1 and FIG. 2 is a front perspective view and a rear perspective view, respectively, of a ground blind 100, which is an example of the inventive portable and collapsible ground blinds. FIG. 3 illustrates an example of ground blind 100 spread out on the ground during setup. FIG. 4 illustrates an example of ground blind 100 rolled up for carrying.

Referring still to FIG. 1 through FIG. 4, ground blind 100 may include a fabric panel 110, which may be generally triangular-shaped. Fabric panel 110 may be, in one non-limiting example, camouflage fabric, such as 500 Denier CORDURA® Nylon fabric (camouflage or camo green) and the like, or may be any other suitable color or material. Then, by installing a center pole (or rod) 142, the fabric panel 110 may be divided or partitioned into two smaller side panels, which may also be generally triangular-shaped. For example, using center pole 142, fabric panel 110 may be divided or partitioned into a first side panel 120 and a second side panel 130. A fold line 140 may be formed along center pole 142, which is the common boundary of first side panel 120 and second side panel 130. In addition to being bounded by fold line 140 along center pole 142, first side panel 120 may have a side edge 122 and a lower edge 124. In addition to being bounded by fold line 140 along center pole 142, second side panel 130 may have a side edge 132 and a lower edge 134. A pole (or rod) 126 (not visible) may be, for example, sewn into each of side edge 122 and lower edge 124 of first side panel 120 and side edge 132 and lower edge 134. That is, ground blind 100 includes four poles 126 and one center pole 142, for a total of five poles. Poles 126 and center pole 142 may be, for example, tent style poles that can be solid or collapsible. Additionally, there is a window or opening 144 in first side panel 120 and another window or opening 144 in second side panel 130. Ground blind 100 may have an uppermost peak 146 and three lower corners 147.

In one example, poles 126 may be permanently installed (i.e., not removable or detachable). By contrast, the lower end of center pole 142 may be permanently installed at the center lower corner 147 of ground blind 100 while the upper end of center pole 142 may be detachable via a pole connector 148 (see FIG. 3) from peak 146 of ground blind 100. That is, when ground blind 100 is assembled, the upper end of center pole 142 is connected to pole connector 148 at peak 146 of ground blind 100. Then, to breakdown ground blind 100, the upper end of center pole 142 can be detached from pole connector 148 at peak 146 of ground blind 100 (see FIG. 3). Fabric panel 110 has enough stretch to slip the upper end of center pole 142 into or out of pole connector 148. In one example, pole connector 148 is a 3-legged or 3-pronged device that can receive the ends of three poles. In ground blind 100, there is one pole connector 148 at peak 146 and a pole connector 148 at each of the three lower corners 147, for a total of four pole connectors 148. An example of a pole connector is shown and described hereinbelow with reference to FIG. 14 through FIG. 18.

FIG. 3 shows ground blind 100 broken down and with peak 146 folded over atop the center lower corner 147 of fabric panel 110. FIG. 3 shows, for example, a 3-pronged pole connector 148 at peak 146 for holding a pole 126 on each side and for receiving the upper end of center pole 142 at the center. Again, another pole connector (not shown) may be provided at the center lower corner 147 of fabric panel 110 for permanently holding the lower end of center pole 142 and two other poles 126. In ground blind 100, center pole 142 is the only pole that is manipulated during setup and breakdown. All other poles 126 remain intact and connected during setup and breakdown. However, in another example, the upper end of center pole 142 may be permanently installed at peak 146 of ground blind 100 while the lower end of center pole 142 may be detachable via a pole connector 148 (see FIG. 3) at the center lower corner 147 of ground blind 100.

FIG. 3 also shows loops 150 at the lower corners 147. Additionally, a loop 150 (not shown) may be provided at peak 146. Further, ground blind 100 may include cutouts (not shown) alongside edge 122 and/or lower edge 124 of first side panel 120 and/or alongside edge 132 and/or lower edge 134 of second side panel 130.

Once standing, the presently disclosed ground blind 100 may be set at different angles as shown, for example, in FIG. 5A and FIG. 5B. That is, ground blind 100 can be set at any angle α as long as it can stand on its own and as long as there is enough room for the user to position themselves behind ground blind 100. In one example, angle α may range from about 45 degrees to about 90 degrees. Further, the overall size of the presently disclosed ground blind 100 can vary.

Referring now to FIG. 6 is a flow diagram of an example of a method 200 of using the portable and collapsible ground blind 100 shown in FIG. 1 through FIG. 5B, which is one example of the presently disclosed ground blinds and methods. Method 200 may include, but is not limited to, the following steps.

At a step 210, fabric panel 110 is unrolled and then spread out on ground (see FIG. 3) and with the upper end of center pole 142 loose and not yet secured.

At a step 215, with the lower end of center pole 142 secured (e.g., permanently secured), the upper end of center pole 142, which is the loose end, is installed into pole connector 148 at peak 146 of fabric panel 110 (see FIG. 3). Fabric panel 110 has enough stretch to slip the upper end of center pole 142 into pole connector 148.

At a step 220, ground blind 100 is stood up and adjusted to any desired angle. For example, ground blind 100 can be set at any angle α as long as it can stand on its own and as long as there is enough room for the user to position themselves behind ground blind 100.

At an optional step 225, any other anchor mechanisms may be installed with respect to ground blind 100. In one example, stakes may be pounded into the ground and then loops 150 engaged with the stakes. In another example, ropes may be tied to one or more loops 150 and then tied off to some other fixed objects, such as to trees, bushes, rocks, and the like.

Referring now to FIG. 1 through FIG. 6, benefits of the presently disclosed ground blind 100 and method 200 may include, for example, easy and rapid setup (e.g. a few seconds to install center pole 142), easy and rapid height adjustment or leveling by simply spreading out or tightening the angle α between first side panel 120 and second side panel 130, easy to pick up and move at any time, provides effective camouflage cover for the user, provides effective screen to disguise the user's movement, easy to breakdown and transport, and so on.

Figure 8:
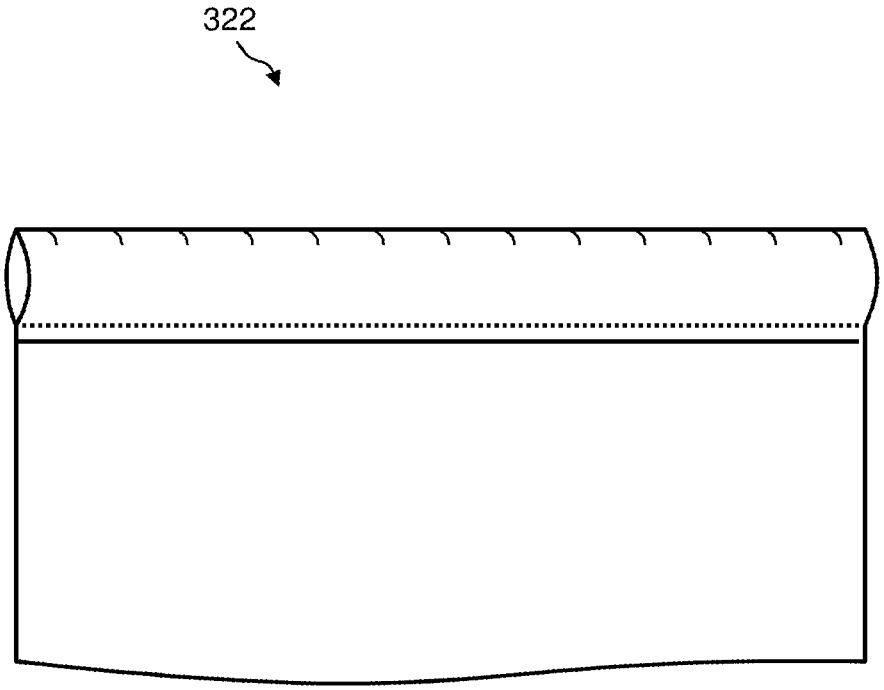

Referring now to FIG. 7 is a plan view of a ground blind 300, which is another example of the presently disclosed portable and collapsible ground blinds. Ground blind 300 may include a fabric panel 310, which may be generally triangular-shaped. Fabric panel 310 may be, in one non-limiting example, camouflage fabric, such as 500 Denier CORDURA® Nylon fabric (camouflage or camo green) and the like, or may be any other suitable color or material. Then, by installing a center pole assembly 342, the fabric panel 310 may be divided or partitioned into two smaller side panels (which may also be generally triangular-shaped. For example, using pole assembly 342, fabric panel 310 may be divided or partitioned into a first side panel 320 and a second side panel 330. A fold line 340 may be formed along pole assembly 342, which may be the common boundary of first side panel 320 and second side panel 330. Each edge of first side panel 320 and second side panel 330 may include a pole sleeve 322. For example, first side panel 320 may have a side pole sleeve 322S and a lower pole sleeve 322L. Similarly, second side panel 330 may have a side pole sleeve 322S and a lower pole sleeve 322L. An example of a pole sleeve 322 is shown in FIG. 8.

In one configuration, both side pole sleeves 322S may hold a pole assembly 342 and both side pole sleeves 322L may hold a pole assembly 342. In this configuration, ground blind 300 includes the four pole assemblies 342 at the edges and one center pole assembly 342, for a total of five poles. However, in another configuration, both side pole sleeves 322S may hold a pole assembly 342 while both side pole sleeves 322L may not hold a pole assembly 342. In this configuration, ground blind 300 includes the two pole assemblies 342 at two edges and one center pole assembly 342, for a total of three poles. In any configuration, any instances of pole assembly 342 may be a 2-piece collapsible pole or rod, such as the 2-piece collapsible pole or rod shown and described hereinbelow with reference to FIG. 13.

Figure 9:
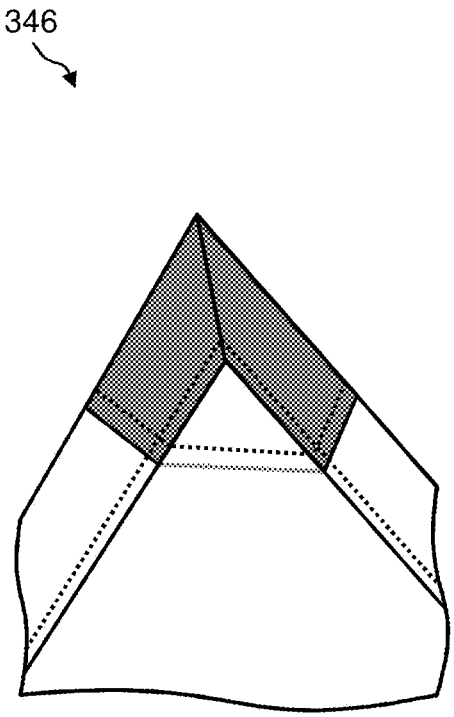
Figure 10:
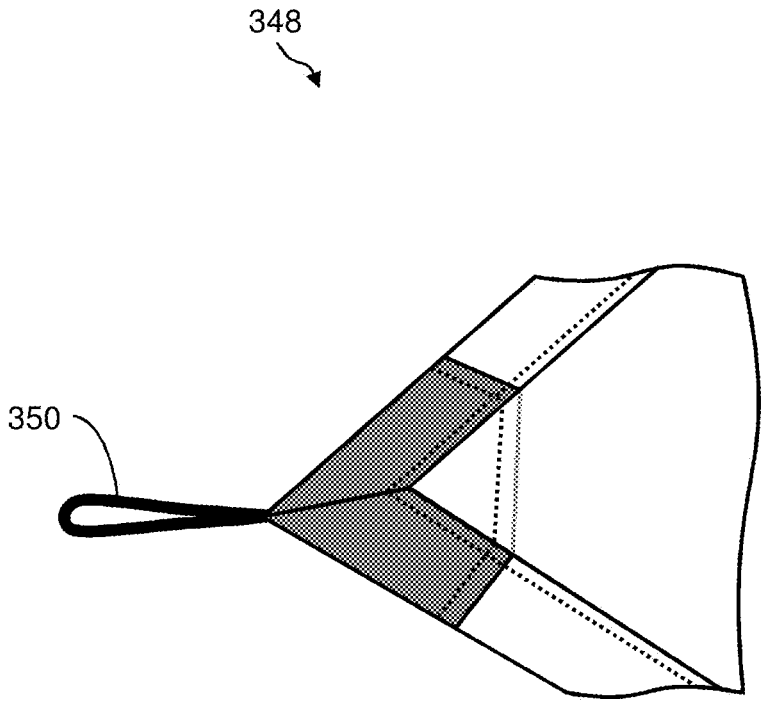
Figure 11:
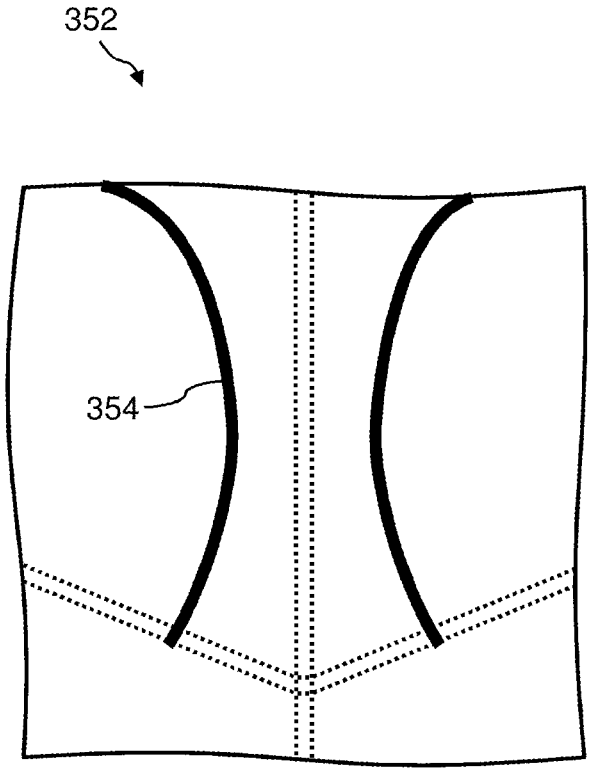

Additionally, a cutout region 324 may be provided at about the center of each of the side pole sleeves 322S and side pole sleeves 322L. Cutout regions 324 allow a user access to any pole assemblies 342 in order to engage or collapse any 2-piece collapsible pole or rod. Further, each of first side panel 320 and second side panel 330 may have a window or opening 344 that a user can look through. Ground blind 300 may have a reinforced upper corner 346 and three reinforced lower corners 348 (i.e., the corners that rest on the ground). An example of a reinforced upper corner 346 is shown in FIG. 9. An example of a reinforced lower corner 348 is shown in FIG. 10. Additionally, a loop 350 (see FIG. 10) may be provided at each of the reinforced lower corners 348. Additionally, ground blind 300 may include center stitching 352 (see FIG. 11) along fold line 340. Additionally, for strength, certain edges of ground blind 300 may be reinforced. For example, cutout regions 324 and/or windows or openings 344 may include reinforced edges 354 (see FIG. 11).

Further, ground blind 300 may include a pole connector assembly 360 (not visible) installed at reinforced upper corner 346 at each of the three reinforced lower corners 348, for a total of four pole connector assemblies 360. That is, each pole connector assembly 360 may be a 3-legged or 3-pronged connector for holding the ends of three poles. More details of an example of pole connector assembly 360 are shown and described hereinbelow with reference to FIG. 14 through FIG. 17.

Referring now to FIG. 12 is a detailed drawing of an example of ground blind 300 shown in FIG. 7 and showing example details, features, and dimensions of ground blind 300. Likewise, FIG. 13 is a detailed drawing of an example of a pole assembly 342 that may be used with ground blind 300 shown in FIG. 7. In this example, pole assembly 342 may include two pole segments 343 coupled via an aluminum ferrule 347, which can be assembled and disassembled via a shock cord 345. In ground blind 300, the breakdown point of each pole assembly 342 substantially aligns with a corresponding cutout region 324.

Figure 14:
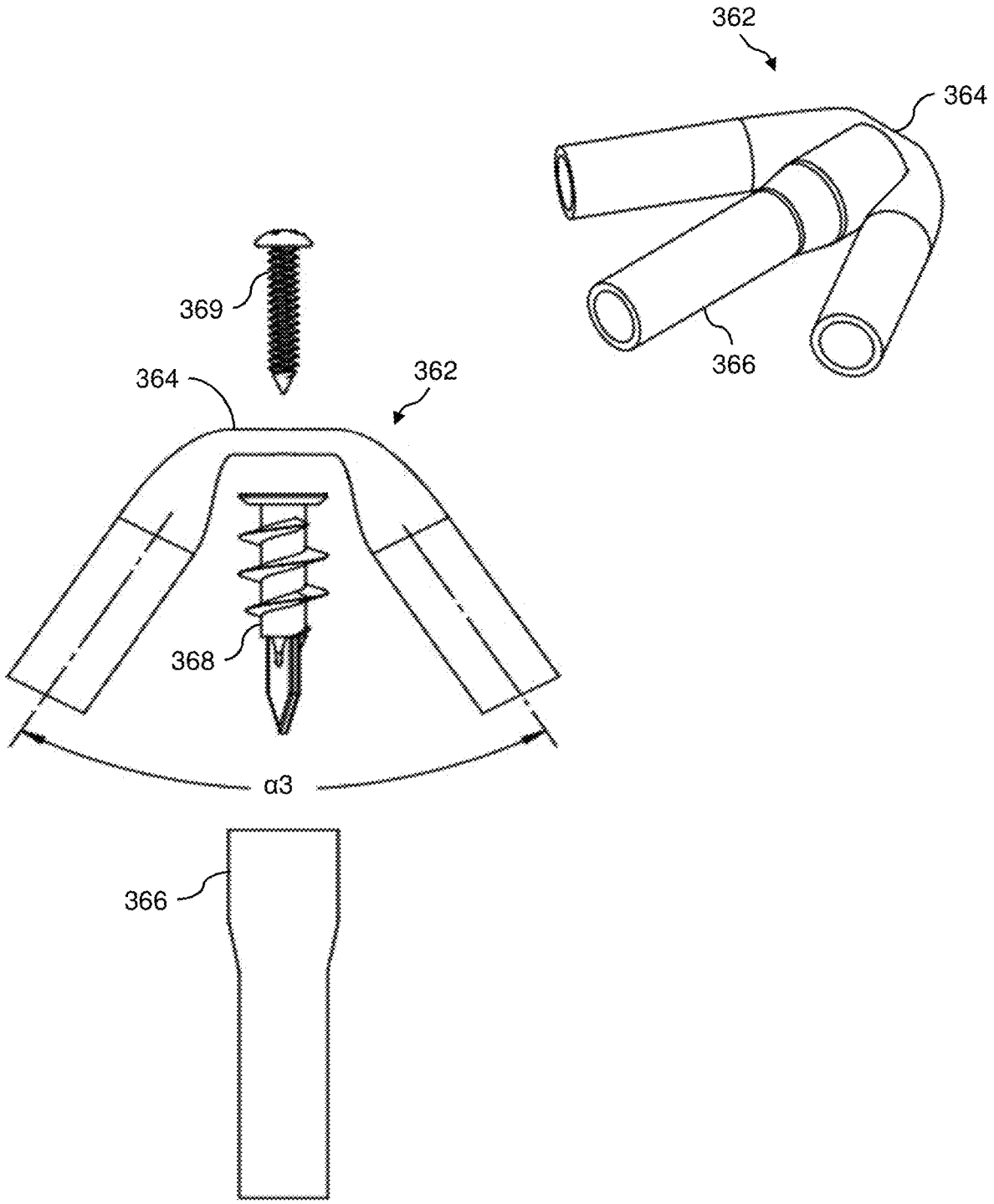
Figure 15:
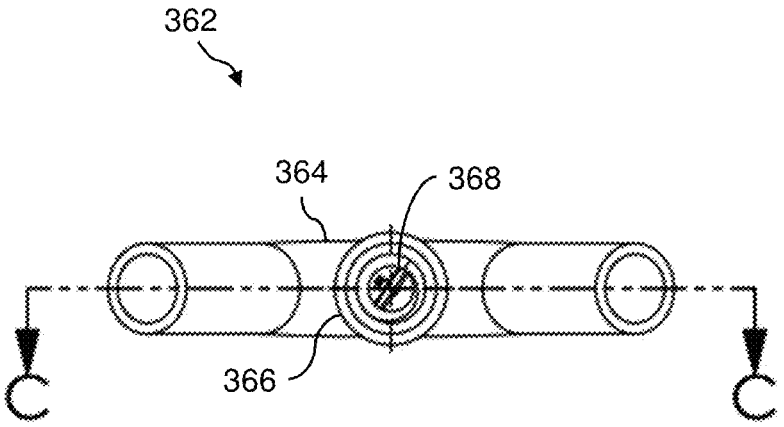
Figure 15:
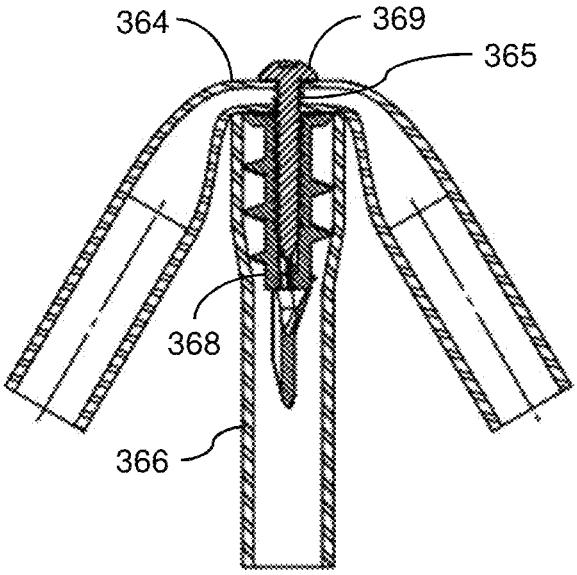

Referring now to FIG. 14 through FIG. 17 are various views showing details of an example of pole connector assembly 360 that may be used with ground blind 300 shown in FIG. 7. FIG. 14 shows a perspective view and an exploded view of pole connector assembly 360. Pole connector assembly 360 may include, for example, a V-shaped tube member 362 that may have a crimped center portion 364, a straight tube member 366, and a drywall anchor assembly. The drywall anchor assembly may include, for example, a drywall anchor 368 (e.g., ⅜-⅝ drywall anchor) that may be press-fitted or screwed into straight tube member 366 of pole connector assembly 360. Then, drywall anchor 368 may be secured to crimped center portion 364 of pole connector assembly 360 via a screw 369 (e.g., 1-inch long sheet metal screw). For example, sheet metal screw 369 may pass through a through-hole or opening 365 in crimped center portion 364 of pole connector assembly 360 (see FIG. 15 and FIG. 16). FIG. 15 shows a side view of pole connector assembly 360 and a cross-sectional view taken along line C-C of the side view. FIG. 16 shows a perspective view, a plan view, and a side view of V-shaped tube member 362 of pole connector assembly 360. FIG. 16 shows that V-shaped tube member 362 may further include through-hole or opening 365 (e.g., 0.13-inch hole) in crimped center portion 364. FIG. 17 shows a perspective view, an end view, and a side view of straight tube member 366 of pole connector assembly 360. FIG. 14 through FIG. 17 show example details, features, and dimensions of pole connector assembly 360.

In ground blind 300, a pole connector assembly 360 may be installed at the reinforced upper corner 346 and at each of the reinforced lower corners 348, for a total of four pole connector assemblies 360. In one example, the upper end of pole assembly 342 is the only pole end that is manipulated during setup and breakdown. The ends of all other pole assemblies 342 remain intact and connected during setup and breakdown. Albeit, the centers of all pole assemblies 342 (e.g., collapsible poles) are manipulated during setup and breakdown to either fold or unfold each of the pole assemblies 342. However, in another example, the upper end of pole assembly 342 may be permanently installed at reinforced upper corner 346 of ground blind 300 while the lower end of pole assembly 342 may be detachable via a pole connector assembly 360 at the center reinforced lower corner 348 of ground blind 300. In this example, the lower end of pole assembly 342 is the only pole end that is manipulated during setup and breakdown.

Referring now again to FIG. 14, V-shaped tube member 362 with the crimped center portion 364 and straight tube member 366 may be formed of flexible material (e.g., rubber hose or rubber tubing material) so that the angle of, for example, V-shaped tube member 362 may be easily adjusted or flexed. For example, FIG. 14 shows the angle of V-shaped tube member 362 set at 60 degrees in a relaxed state. However, when in use, this angle can vary. For example, to adjust the angle α (see FIG. 5A and FIG. 5B) of ground blind 300, the angle of V-shaped tube member 362 can vary due to the flexible material. Additionally, when ground blind 300 is broken down, the angle of V-shaped tube member 362 is at its minimum, which is allowed due to the flexible material.

Referring now again to FIG. 14 through FIG. 17, non-limiting example dimensions of ground blind 300 and its components are shown in Table 1 below. It shall be understood that the dimensions listed below in Table 1 are non-limiting, and the dimension values may be less than or greater than those listed in the table.

TABLE 1

Example dimensions of ground blind 300 and its components

| Component | Dimension name | Dimension (in/cm) | FIG. # |
|---|---|---|---|
| ground blind 300 | d1 | about 109 in (276.8 cm) | FIG. 12 |
| ground blind 300 | d2 | about 63 in (160 cm) | FIG. 12 |
| ground blind 300 | d3 | about 63 in (160 cm) | FIG. 12 |
| ground blind 300 | d4 | about 63 in (160 cm) | FIG. 12 |
| ground blind 300 | d5 | about 15 in (38.1 cm) | FIG. 12 |
| ground blind 300 | d6 | about 34 in (86.4 cm) | FIG. 12 |
| ground blind 300 | d7 | about 4 in (10.1 cm) | FIG. 12 |
| ground blind 300 | angle α1 | about 120 degrees | FIG. 12 |
| ground blind 300 | angle α2 | about 60 degrees | FIG. 12 |
| pole assembly 342 | L1 | about 59 in (149.9 cm) | FIG. 13 |
| pole assembly 342 | L2 | about 29.5 in (74.9 cm) | FIG. 13 |
| pole assembly 342 | diameter D | about 0.375 in (0.95 cm) | FIG. 13 |
| V-shaped tube member 362 | angle α3 | about 60 degrees | FIG. 14, 16 |
| V-shaped tube member 362 | d8 | about 0.63 in (1.6 cm) | FIG. 16 |
| V-shaped tube member 362 | d9 | about 1.25 in (3.2 cm) | FIG. 16 |
| V-shaped tube member 362 | OD1 | about 0.5 in (1.27 cm) | FIG. 16 |
| V-shaped tube member 362 | ID1 | about 0.38 in (0.96 cm) | FIG. 16 |
| straight tube member 366 | d10 | about 2.5 in (6.35 cm) | FIG. 17 |
| straight tube member 366 | OD2 | about 0.5 in (1.27 cm) | FIG. 17 |
| straight tube member 366 | ID2 | about 0.38 in (0.96 cm) | FIG. 17 |

Referring now to FIG. 18 is a flow diagram of an example of a method 400 of using ground blind 300 shown in FIG. 7 through FIG. 17, which is another example of the presently disclosed ground blinds and methods. Method 400 may include, but is not limited to, the following steps.

At a step 410, fabric panel 310 is unrolled and then spread out on ground.

At a step 415, all pole assemblies 342 are unfolded and assembled to full length and while leaving loose one end of center pole assembly 342. For example, when ground blind 300 includes five pole assemblies 342 (e.g., at the four edges and at the center) all five pole assemblies 342 are unfolded and assembled to full length. The upper end of the center pole assembly 342 is still loose (not connected).

At a step 420, with the lower end of the center pole assembly 342 secured (e.g., permanently secured), the upper end of the center pole assembly 342, which is the loose end, is installed into pole connector assembly 360 at reinforced upper corner 346 of ground blind 300. Fabric panel 310 has enough stretch to slip the upper end of the center pole assembly 342 into pole connector assembly 360.

At a step 425, ground blind 300 is stood up and adjusted to any desired angle. For example, ground blind 300 can be set at any angle α as long as it can stand on its own and as long as there is enough room for the user to position themselves behind ground blind 300.

At an optional step 430, any other anchor mechanisms may be installed with respect to ground blind 300. In one example, stakes may be pounded into the ground and then loops 350 engaged with the stakes. In another example, ropes may be tied to one or more loops 350 and then tied off to some other fixed objects, such as to trees, bushes, rocks, and the like.

Referring now to FIG. 7 through FIG. 18, benefits of the presently disclosed ground blind 300 and method 400 may include, for example, easy and rapid setup (e.g. a few seconds to unfold and assemble all pole assemblies 342 and then install center pole assembly 342), easy and rapid height adjustment or leveling by simply spreading out or tightening the angle α between first side panel 320 and second side panel 330, easy to pick up and move at any time, provides effective camouflage cover for the user, provides effective screen to disguise the user's movement, easy to breakdown and transport, and so on. Additionally, ground blind 100 of FIG. 1 through FIG. 6 may include solid poles (e.g., center pole 142 and poles 126) that do not fold when ground blind 100 is broken down. Accordingly, ground blind 100 is broken down at full length for transport and storage, as shown in FIG. 4. By contrast, ground blind 300 may include the collapsible pole assemblies 342 that allow ground blind 300 to be folded in half when broken down for yet easier transport and storage. For example, the length of ground blind 300 when broken down may be about half the length of ground blind 100 when broken down.

Further, the presently disclosed ground blind 100 and method 200 and/or ground blind 300 and method 400 may be used for any purpose, such as, but not limited to, a blind for hunting, observation, photography, and the like. Additionally, the presently disclosed ground blind 100 and method 200 and/or ground blind 300 and method 400 may be used as a sun shade or sun screen device.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A ground blind system, comprising:

a. a fabric panel;

b. a plurality of poles, wherein the plurality of poles includes a center support pole, wherein when installed the center support pole divides the fabric panel longitudinally into two smaller generally triangular shape portions of substantially the same size; and c. a plurality of pole connectors, wherein one or more of the plurality of pole connectors comprise a generally V-shaped flexible tube member with a generally flattened center portion and a generally straight tube member extending from the generally flattened center portion of the generally V-shaped flexible tube member, and wherein the plurality of pole connectors are configured to engage with an end portion of one or more of the plurality of poles; and wherein in an assembled state the assembled structure of the fabric panel and plurality of poles are configured such that the structure is self-supporting, and wherein an angle between the two smaller generally triangular shape portions is variable.

2. The ground blind system of claim 1, wherein the fabric panel has one of a generally triangular or rhombus shape.

3. The ground blind system of claim 1, wherein the plurality of poles comprise collapsible poles.

4. The ground blind system of claim 1, wherein the plurality of poles further comprise a first side support pole and a second side support pole, wherein in the assembled state the first side support pole is disposed along a first side edge of the fabric panel and the second side support pole is disposed along a second side edge of the fabric panel.

5. The ground blind system of claim 4, wherein in the assembled state a first end of each of the center, first side, and second side support poles convene at a peak of the assembled structure, and wherein the first side support pole diverges along it length at a first angle away from the center support pole, and the second side support pole diverges along it length at a second angle away from the center support pole.

6. The ground blind system of claim 5, wherein the first angle and the second angle are substantially equal.

7. The ground blind system of claim 5, wherein the first end of each of the center, first side, and second side support poles are engageable with one another via one of the plurality of pole connectors.

8. The ground blind system of claim 5, wherein the plurality of poles further includes a first bottom support pole and a second bottom support pole, wherein in the assembled state the first bottom support pole is disposed along a lower edge portion of a first one of the two smaller generally triangular shape portions and the second bottom support pole is disposed along a lower edge portion of a second one of the two smaller generally triangular shape portions, and wherein a second end of the first bottom support pole is engageable with a first end of the second bottom support pole.

9. The ground blind system of claim 8, wherein in the assembled state a second end of the center pole is engageable with the second end of the first bottom support pole and the first end of the second bottom support pole.

10. The ground blind system of claim 9, wherein the second end of the center pole, second end of the first bottom support pole, and first end of the second bottom support pole are engageable with one another via one of the plurality of pole connectors.

11. The ground blind system of claim 8, wherein in the assembled state a second end of the first side support pole is engageable with a first end of the first bottom support pole and a second end of the second side support pole is engageable with a second end of the second bottom support pole.

12. The ground blind system of claim 11, wherein the second end of the first side support pole and the first end of the first bottom support pole are engageable via one of the plurality of pole connectors and the second end of the second side support pole and the second end of the second bottom support pole are engageable via another one of the plurality of pole connectors.

13. The ground blind system of claim 11, further comprising a reinforced pocket at one or more corners of the fabric panel, wherein the reinforced pocket is configured to receive at least one of the plurality of pole connectors and/or an end of one or more of the plurality of poles.

14. The ground blind system of claim 1, further comprising one or more openings in one or both of the two smaller generally triangular shape portions.

15. The ground blind system of claim 14, wherein the one or more openings comprise a closeable window.

16. The ground blind system of claim 1, further comprising one or more loops disposed at one or more corners of the fabric panel.

17. A method of using a ground blind system, the method comprising:

a. providing a ground blind system, the ground blind system comprising:
   i. a fabric panel;
   ii. a plurality of poles, comprising at least a center support pole, a first side support pole, and a second side support pole; and
   iii. a plurality of pole connectors, wherein one or more of the plurality of pole connectors comprise a generally V-shaped flexible tube member with a generally flattened center portion and a generally straight tube member extending from the generally flattened center portion of the generally V-shaped flexible tube member, and wherein the plurality of pole connectors are configured to engage with an end portion of one or more of the plurality of poles;
b. installing the plurality of poles within the fabric panels to form an assembled structure, wherein the first side support pole is disposed along a first side edge of the fabric panel, the second side support pole is disposed along a second side edge of the fabric panel, and the center support pole is disposed such that it divides the fabric panel longitudinally into two smaller generally triangular shape portions of substantially the same size, wherein the assembled structure is self-supporting; and
c. adjusting the two smaller generally triangular shape portions to a desired angle therebetween.

18. A method of assembling a ground blind system, the method comprising:

a. providing a ground blind system in a folded state, the ground blind system comprising:
   i. a fabric panel;
   ii. a plurality of poles, comprising at least a center support pole, a first side support pole, and a second side support pole; and
   iii. a plurality of pole connectors, wherein one or more of the plurality of pole connectors comprise a generally V-shaped flexible tube member with a generally flattened center portion and a generally straight tube member extending from the generally flattened center portion of the generally V-shaped flexible tube member, and wherein the plurality of pole connectors are configured to engage with an end portion of one or more of the plurality of poles;
b. unrolling the fabric panel with at least the center support pole, first side support pole, and second side support pole of the plurality of poles disposed therein;
c. extending the plurality of poles to their full length;
d. securing any unsecured ends of the plurality of poles with one or more of the plurality of pole connectors and/or within one or more corner pockets of the fabric panel to form an assembled structure, wherein the first side support pole is disposed along a first side edge of the fabric panel, the second side support pole is disposed along a second side edge of the fabric panel, and the center support pole is disposed along a middle portion of the fabric panel such that it divides the fabric panel longitudinally into two smaller generally triangular shape portions of substantially the same size, and wherein the assembled structure is self-supporting; and
e. adjusting the two smaller generally triangular shape portions to a desired angle therebetween.

19. The method of claim 18, wherein one or more of the plurality of pole connectors are disposed within one or more of the one or more corner pockets of the fabric panel.

20. A method of disassembling a ground blind system, the method comprising:

a. providing a ground blind system in an assembled state, the ground blind system comprising:
   i. a fabric panel;
   ii. a plurality of poles, comprising at least a center support pole, a first side support pole, and a second side support pole; and
   iii. a plurality of pole connectors, wherein one or more of the plurality of pole connectors comprise a generally V-shaped flexible tube member with a generally flattened center portion and a generally straight tube member extending from the generally flattened center portion of the generally V-shaped flexible tube member, and wherein the plurality of pole connectors are configured to engage with an end portion of one or more of the plurality of poles;
b. unsecuring a secured end of at least the center support pole;
c. collapsing at least the center support pole, first side support pole, and second side support pole of the plurality of poles to a reduced length; and
d. rolling up the fabric panel with at least the center support pole, first side support pole, and second side support pole of the plurality of poles disposed therein.

* * * * *